United States Patent [19]

Ewing

[11] Patent Number: 4,485,655

[45] Date of Patent: Dec. 4, 1984

[54] TOOL HOLDER FOR A MINING TOOL BIT AND METHOD FOR MAKING SAME

[75] Inventor: Peter D. Ewing, Milford, Mich.

[73] Assignee: National Set Screw Corporation, Plymouth, Mich.

[21] Appl. No.: 201,940

[22] Filed: Oct. 29, 1980

[51] Int. Cl.[3] ..... B21K 5/01

[52] U.S. Cl. ..... 72/68; 72/69; 72/377; 175/354

[58] Field of Search ..... 72/68, 69, 88, 107, 72/108, 109, 356, 377; 175/354; 29/DIG. 49; 76/101 R, 108 R, 108 A

[56] References Cited

U.S. PATENT DOCUMENTS

| | | | |
|---|---|---|---|
| 1,493,836 | 5/1924 | Wurster | 72/107 |
| 2,141,753 | 12/1938 | Hufferd et al. | 72/377 |
| 3,528,271 | 9/1970 | DiPonio | 72/108 |
| 3,712,099 | 1/1973 | Elsbett et al. | 72/107 |
| 3,720,273 | 3/1973 | McHenry et al. | 175/354 |
| 4,245,846 | 1/1981 | Andrews | 76/101 R |

FOREIGN PATENT DOCUMENTS

| | | | |
|---|---|---|---|
| 2261154 | 12/1973 | Fed. Rep. of Germany | 72/108 |
| 4191 | 2/1975 | Japan | 72/108 |

*Primary Examiner*—Lowell A. Larson

*Attorney, Agent, or Firm*—Reising, Ethington, Barnard, Perry & Milton

[57] ABSTRACT

A tool holder for a mining tool bit is disclosed; it comprises a unitary steel body with a cylindrical shank for supporting the tool holder and a conical head for holding a tool bit. The shank includes a retaining neck constructed of a roll-formed portion of the shank. A cylindrical section between the shank and the head includes an extracting neck which is constructed of a roll-formed portion of the section.

1 Claim, 7 Drawing Figures

TOOL HOLDER FOR A MINING TOOL BIT AND METHOD FOR MAKING SAME

FIELD OF THE INVENTION

This invention relates to a tool holder and more particularly, it relates to a tool holder of the quick change type especially adapted for a mining bit.

BACKGROUND OF THE INVENTION

In mining operations, such as coal mining, a machine known as a shearer is used for excavating. The shearer, when used in longwall mining for example, has a rotating drum which carries a set of helically arranged cutting tools for cutting into the vein of coal. Each cutting tool is individually mounted on the drum, typically by a mounting block. The mounting block is provided with a socket which is adapted to receive the shank of a tool holder which carries a cutting bit.

In the prior art, the tool holder comprises a cylindrical shank adapted to be inserted into the socket of a mounting block, a conical head adapted to receive the tool bit, and a cylindrical section between the shank and the head. The shank is provided with an annular groove for receiving a retaining member to retain the tool holder in the block. The cylindrical section is provided with an annular groove for receiving an extracting tool for removal of the tool holder from the block. In the prior art, the tool holder of this type is made from a steel rod by machining, as by a lathe operation, to obtain the desired shape. The prior art tool holder has the disadvantage, not only of the high cost of the machining operation, but also a resulting structure which leaves room for improvement in strength and other properties.

A general object of this invention is to provide an improved mining bit tool holder which overcomes certain disadvantages of the prior art.

SUMMARY OF THE INVENTION

In accordance with this invention, a mining bit tool holder comprises a unitary steel body including a cylindrical shank, a conical head, and a cylindrical section between the shank and the head and having a retaining neck in the shank constructed of a roll-formed portion thereof and a retracting neck in the cylindrical section constructed of a roll-formed portion thereof. The shank, cylindrical section and conical head are constructed of cold-headed portions of said body.

A more complete understanding of this invention may be obtained from the detailed description that follows taken with the accompanying drawings.

BEST MODE FOR CARRYING OUT THE INVENTION

Figure 1:
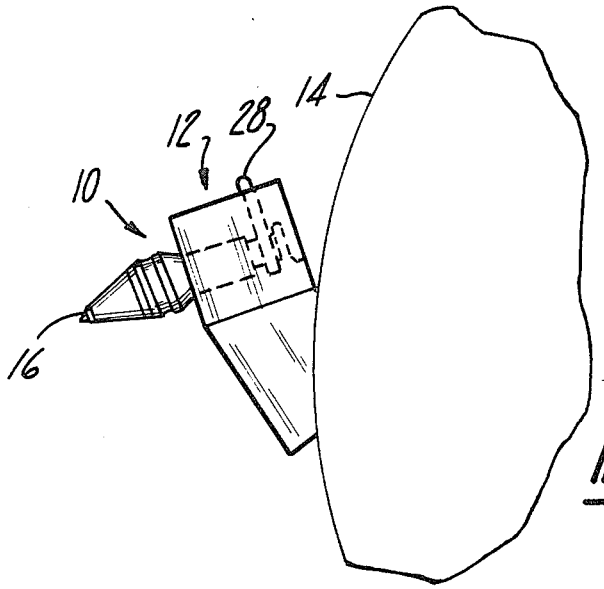
FIG. 1 shows the tool holder installed in a mounting block.

Referring now to the drawings, there is shown an illustrative embodiment of the invention in a particular tool holder for a mining tool bit such as that used in a coal mining shearing machine. It will be appreciated, as the description proceeds, that the invention may be used for tool holders of other configurations.

The tool holder 10, of this invention, is shown in FIG. 1 as installed in a mounting block 12 on the drum 14 of a shearer. The tool holder 10 supports a tool bit 16 of hardened material, such as tungsten carbide, at its outer end. It will be understood that the drum 14 of the shearer carries a large number of such tool holders which are typically disposed in a helical path on the surface of the drum. In a shearing operation, the drum is rotated and moved in an axial direction with the tool bits engaging the coal vein to shear a layer of coal therefrom. The tool holder is thus subjected to very large stresses and it must exhibit great strength and toughness.

Figure 2:
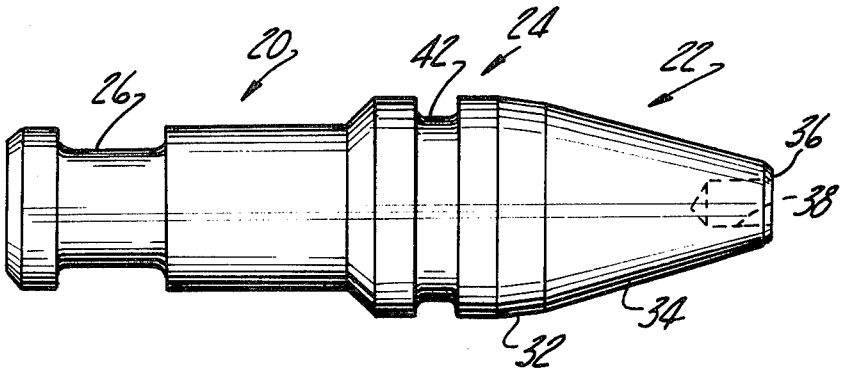
FIG. 2 is an elevation view of the tool holder according to this invention.
Figure 3:
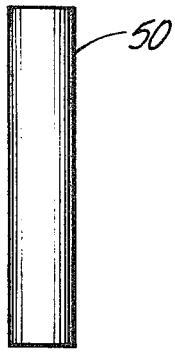
FIG. 3 is an elevation view of a cylindrical blank from which the tool holder is formed.
Figure 4:
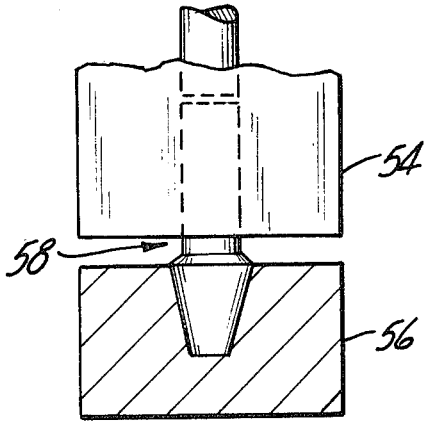
FIGS. 4 and 5 show intermediate blanks of the tool holder at intermediate stages in respective heading dies.

The tool holder, as best shown in FIG. 2, comprises a unitary steel body having a cylindrical shank 20 and a conical head 22 joined to the shank by a cylindrical intermediate section 24. The illustrative embodiment of the tool holder has an overall length of about 4.7 inches and a diameter, at its largest part, of about 1.3 inches. The shank has an axial length approximately the same as that of the conical head 22. The shank 20 is adapted to removably support the tool holder in a cylindrical socket of the block 12. For this purpose, the shank 20 is of circular cross-section and is provided with a retaining groove or neck 26 of reduced diameter adjacent the rear end of the shank. The neck 26 defines an annular groove in the shank 20 and is constructed of a roll-formed portion of the shank. The neck 26 is adapted to receive a U-shaped retaining member or clevis 28 which extends through the block 12 and straddles the neck 26 (see FIG. 1). The neck 26 is substantially longer than the thickness of the clevis 28 whereby the tool holder is allowed some freedom of axial motion in the socket in the block. This imposes severe strain and wear on the neck 26 of the shank. The neck 26 has a diameter approximately equal to 0.7 times the diameter of the shank and, in the illustrative tool holder, the depth of the annular groove at the neck is about $\frac{1}{8}$ inch or more.

The conical head 22 comprises an annular base 32 with a truncated nose 34 extending therefrom and terminating in a free end face 36. The end face is provided with a cylindrical recess 38 adapted to receive the cutting bit 16. The conical head 22 is designed to resist the very large shearing and bending forces to which it is subjected during operation.

The cylindrical intermediate section 24 of the tool holder is circular in cross-section and includes an extracting groove or neck 42 of reduced diameter. The neck 42 is adapted to receive an extracting tool for pulling the tool holder from the block to replace it. The neck 42 is constructed of a roll-formed portion of the intermediate section 24. The neck 42 has an axial length approximately equal to 0.2 times the diameter thereof and the diameter of the neck 42 is approximately equal to 0.8 times the diameter of the intermediate section 24, the depth of theannular groove being about $\frac{1}{8}$ inch.

Figure 5:
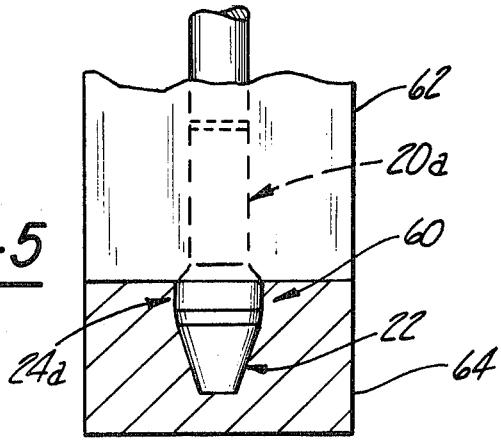

The tool holder, as described above, is made in accordance with the following method, which will be described with reference to FIGS. 3 through 7. The tool holder is formed from a cylindrical metal blank 50, shown in FIG. 3. The blank 50 is upset or cold-headed in a suitable number of operations to produce an intermediate blank 60 which is depicted in FIG. 5. These preliminary forming steps are suitably as follows. The blank 50 is placed in a gripping die 54 and is cold-headed by a heading die 56 to form an intermediate blank 58. The intermediate blank 58 is then placed in a gripping die 62, as depicted in FIG. 5, and is cold-headed by a heading die 64 to form the intermediate blank 60. The cold-heading operation finishes the conical head 22 to its final dimensions. Also, the cold-heading operation finishes the diameter of the shank 20*a* and the diameter of intermediate section 24*a* to their final dimensions; however, it remains to form the retaining neck 26 in the shank and the extracting neck 42 in the intermediate section.

Figure 6:
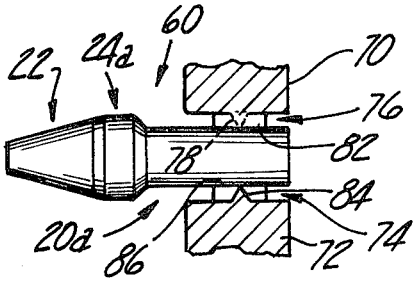
FIG. 6 depicts a roll-forming tool for providing the retaining neck on the tool holder.

The retaining neck 26 is formed to its final dimensions by roll-forming the intermediate blank 60, as depicted in FIG. 6. The roll-forming is preferably performed in a conventional manner by flat dies in a cold-forming operation as depicted in FIG. 6. It utilizes a pair of flat dies 70 and 72 with the intermediate blank 60 disposed therebetween. The stationary die 72 is provided with a ridge 74 and the reciprocating die 70 is provided with an oppositely disposed ridge 76. The ridges 74 and 76 extend parallel to each other and in a direction perpendicular to the axis of the intermediate blank 60. The ridge 74, as illustrated, has a triangular cross-section 78 of small height at one end (the near end) and has a substantially rectangular cross-section 82 at the other end (far end). The ridge 74 has a triangular cross-section 84 of small height at the far end and a substantially rectangular cross-section 86 of larger height at the near end. The blank 60 is loaded into position between the dies with the ridges 74 and 76 engaging the shank 20*a* at the respective triangular cross-section 78 and 84. The reciprocating die 70 is advanced relative to the stationary die 72 (into the paper, as viewed in FIG. 6) and the blank 60 is rolled therebetween to progressively form the neck 26 (FIG. 2) in the surface of the shank 20. This rolling displaces the metal of the shank in such a manner that the diameter of the neck is reduced and the axial length of the shank is increased. Because a large amount of material is displaced in the roll-forming operation, it is preferably performed with the blank 60 at a temperature of about 1200° F. At this temperature, a significant amount of strain hardening occurs which improves the strength and the toughness of the neck 26. Thus, the work hardened neck has a grain structure different from that which would be produced if the final dimensions of the neck were provided by metal removal by a machining operation. The form-rolling operation affords good dimensional control so that the neck 26 is held to close tolerance.

Figure 7:
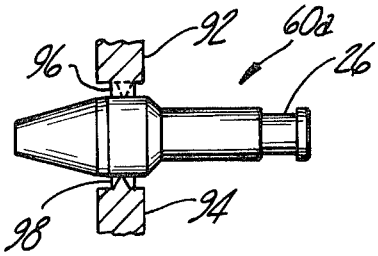
FIG. 7 depicts a roll-forming tool for providing the extracting neck on the tool holder.

The form-rolling operation just described, with reference to FIG. 6, results in an intermediate blank 60*a* depicted in FIG. 7. The retracting neck 42 is formed to its final dimensions by roll-forming the intermediate blank 60*a*, as depicted in FIG. 7. The roll-forming operation is performed in the same manner as that described with reference to FIG. 6. It utilizes a pair of flat dies 92 and 94 having ridges 96 and 98, respectively. The rolling operation displaces the metal of the intermediate section 24 in such a manner that the diameter of the neck is reduced and the axial length of the intermediate section is increased. Because of the amount of material displaced in the roll-forming operation, it is advantageously performed with the blank 60*a* at a temperature of about 550° F. This produces a significant amount of strain hardening which improves the strength and toughness of the neck 42.

The tool holder, as shown in FIG. 2, is formed to its final external dimensions by the cold-heading and roll-forming operations as described above. The cylindrical recess 38 for the tool bit is suitably formed by drilling as a final operation.

Although the description of this invention has been given with reference to a particular embodiment, it is not to be construed in the limiting sense. Many variations and modifications will now occur to those skilled in the art. For a definition of the invention reference is made to the appended claims.

What is claimed is:

1. The method of making a tool holder for a mining tool bit, said tool holder being of the type comprising a unitary steel body including a cylindrical shank adapted to be inserted into the socket of a support block, a conical head adapted to receive a tool bit, and a cylindrical section between the shank and the head, said method comprising the steps of, cold-heading a cylindrical steel blank to provide an intermediate blank with said cylindrical shank, conical head, and cylindrical section between the head and the shank, reducing said shank by roll-forming to provide a first neck defining an annular retaining groove in said shank for receiving a retaining member in said block, said roll-forming of said shank being performed by rolling said shank between a pair of flat dies at a temperature of about 1200 degrees F., said first neck having an axial length approximately equal to its diameter and having a diameter equal to 0.7 times the diameters of the shank, reducing said cylindrical section by roll-forming to provide a second neck defining an annular extraction groove in said cylindrical section for receiving an extracting means for removal of said tool holder from said block, said roll-forming of said section being performed by rolling said second neck portion between a pair of flat dies at a temperature of about 550 degrees F., said second neck having an axial length approximately to 0.2 times the diameter of said second neck and having a diameter about 0.8 times the diameter of said cylindrical section.

* * * * *